US008027434B2

(12) United States Patent
Sakabe

(10) Patent No.: US 8,027,434 B2
(45) Date of Patent: Sep. 27, 2011

(54) ROTATING ANTICATHODE X-RAY GENERATING APPARATUS AND X-RAY GENERATING METHOD

(75) Inventor: Noriyoshi Sakabe, Tsukuba (JP)

(73) Assignees: Noriyoshi Sakabe, Tsukuba (JP); Kiwako Sakabe, Tsukuba (JP); Naomi Shimura, Suita (JP)

( * ) Notice: Subject to any disclaimer, the term of this patent is extended or adjusted under 35 U.S.C. 154(b) by 808 days.

(21) Appl. No.: 12/010,825

(22) Filed: Jan. 30, 2008

(65) Prior Publication Data

US 2010/0290596 A1 Nov. 18, 2010

(30) Foreign Application Priority Data

Jul. 11, 2007 (JP) ..... 2007-181979

(51) Int. Cl.
*H01J 35/10* (2006.01)

(52) U.S. Cl. ..... 378/144; 378/119

(58) Field of Classification Search ..... 378/119–144
See application file for complete search history.

(56) References Cited

U.S. PATENT DOCUMENTS

2007/0223655 A1* 9/2007 Sakabe ..... 378/119
2010/0135465 A1* 6/2010 Sakabe ..... 378/144

FOREIGN PATENT DOCUMENTS

JP A-2004-172135 6/2004

* cited by examiner

*Primary Examiner* — Courtney Thomas
(74) *Attorney, Agent, or Firm* — Oliff & Berridge, PLC.

(57) ABSTRACT

A rotating anticathode X-ray generating apparatus which is configured such that an X-ray is generated by an irradiation of an electron beam emitted from a cathode includes a rotating anticathode with an electron beam irradiating portion to generate the X-ray through the irradiation of the electron beam so that a direction of the electron beam is set equal to a direction of a centrifugal force caused by a rotation of the rotating anticathode; and a film for covering at least the electron beam irradiating portion so as to prevent an evaporation of a material making the rotating anticathode.

14 Claims, 2 Drawing Sheets

ROTATING ANTICATHODE X-RAY GENERATING APPARATUS AND X-RAY GENERATING METHOD

CROSS-REFERENCE TO RELATED APPLICATIONS

This application is based upon and claims the benefit of priority from the prior Japanese Patent Application No. 2007-181979, filed on Jul. 11, 2007; the entire contents of which are incorporated herein by reference.

BACKGROUND OF THE INVENTION

1. Field of the Invention

This invention relates to a rotating anticathode X-ray generating apparatus and an X-ray generating method for generating an X-ray with ultrahigh brightness.

2. Description of the Related Art

In X-ray diffraction measurement, it may be required to irradiate an X-ray with as high intensity as possible onto a sample. In this case, a conventional rotating anticathode type X-ray generating apparatus would be employed for the X-ray diffraction measurement.

The rotating anticathode X-ray generating apparatus is configured such that an electron beam is irradiated onto the outer surface of the columnar anticathode (target) in which a cooling medium is flowed while the anticathode is rotated at high speed. In comparison with a stationary target X-ray generating apparatus, the rotating anticathode X-ray generating apparatus can exhibit extreme cooling efficiency because the irradiating position of the electron beam on the anticathode changes with time. Therefore, in the rotating anticathode X-ray generating apparatus, the electron beams can be irradiated onto the anticathode in large electric current, thereby generating an X-ray with high intensity (brightness).

By the way, the intensity of the resultant X-ray generated is in proportion to the electric power (current voltage) to be applied between the cathode and the anticathode. On the other hand, since the brightness of the X-ray can be represented by (electric power)/(area of electron beams on target), the maximum value in output of the X-ray depends largely on the area of the electron beam on the target. For example, the output intensity of the X-ray can be enhanced only to 1.2 kW at a maximum in the conventional laboratory rotating Cu anticathode type X-ray generating apparatus when the electron beam is irradiated onto the target at a spot size of 0.1×1 mm, and also only to 3.5 kW at a maximum in an ultrahigh brightness rotating anticathode type X-ray generating apparatus.

In this point of view, such a technique is disclosed in Japanese Patent Application Laid-open No. 2004-172135 as irradiating the electron beam onto the inner surface of the cylindrical portion which is rotated around the center axis of the rotating anticathode X-ray generating apparatus and heating the electron beam irradiating portion beyond the melting point of the material making the cylindrical portion, thereby generating the high bright X-ray. In this case, since the electron beam irradiating portion is heated beyond the melting point of the material of the cylindrical portion, the electron beam irradiating portion is at least partially melted. However, since the electron beam irradiating portion is held on the cylindrical portion by the centrifugal force caused by the rotation of the rotating anticathode, the melted portion of the electron beam irradiating portion can not be splashed.

In the conventional technique, however, since the electron beam irradiating portion is at least partially melted through the heating beyond the melting point of the material of the cylindrical portion, the area around the electron beam irradiating portion is heated to a relatively high temperature so that the vapor pressure of the area becomes high. As a result, the rotating anticathode (cylindrical portion) is consumed remarkably so that the utilization efficiency of the rotating anticathode may be deteriorated.

[Patent Application No. 1]

Japanese Patent Application Laid-open No. 2004-172135

BRIEF SUMMARY OF THE INVENTION

It is an object of the present invention, in a rotating anticathode X-ray generating apparatus and an X-ray generating method, to suppress the consumption of the rotating anticathode by the irradiation of electron beams onto the rotating anticathode.

In order to achieve the above object, the present invention relates to a rotating anticathode X-ray generating apparatus which is configured such that an X-ray is generated by an irradiation of an electron beam emitted from a cathode, including: a rotating anticathode with an electron beam irradiating portion to generate the X-ray through the irradiation of the electron beam so that a direction of the electron beam is set equal to a direction of a centrifugal force caused by a rotation of the rotating anticathode; and a film for covering at least the electron beam irradiating portion so as to prevent an evaporation of a material making the rotating anticathode.

Moreover, the present invention relates to a method for generating an X-ray by irradiating an electron beam from a cathode, including the steps of: forming an electron beam irradiating portion on a rotating anticathode so that a direction of the electron beam is set equal to a direction of a centrifugal force caused by a rotation of the rotating anticathode, thereby generating the X-ray; and covering at least the electron beam irradiating portion with a film so as to prevent an evaporation of a material making the rotating anticathode.

According to the rotating anticathode X-ray generating apparatus and the X-ray generating method, the electron beam irradiating portion which is formed at the generation of the X-ray through the irradiation of the electron beam is covered with the film, and then the X-ray is generated from the electron beam irradiating portion. Therefore, even though the electron beam irradiating portion is heated beyond the melting point of the material making the rotating anticathode so that the vapor pressure of the material is increased, the evaporation of the material is prevented by the film. As a result, the consumption of the rotating anticathode due to the irradiation of the electron beam can be reduced.

In an embodiment, the rotating anticathode includes a cylindrical portion with a center axis corresponding to a rotation center of the rotating anticathode, and the electron beam irradiating portion is formed on an inner wall of the cylindrical portion. In this case, the electron beam irradiating portion can be easily formed at the rotating anticathode so that the irradiating direction of the electron beam is set equal to the direction of the centrifugal force.

In another embodiment, the electron beam irradiating portion is positioned in an inverted trapezoidal trench formed at the rotating anticathode and the film is formed in the trench. In this case, the film can be fixed strongly to the rotating anticathode so as not to be released from the rotating anticathode.

In still another embodiment, the electron beam irradiating portion is configured so as to be at least partially melted by the electron beam. In this case, since the electron beam with high intensity is irradiated on the electron beam irradiating portion, the brightness of the X-ray to be generated from the electron beam irradiating portion can be increased.

In a further embodiment, the film is made of a material not soluble for the rotating anticathode. If the film is solid-solved with the rotating anticathode, the film may disappear so as not to prevent the evaporation of the material making the rotating anticathode.

In a still further embodiment, the film includes at least one selected from the group consisting of graphite, diamond, alumina, calcium oxide, magnesium oxide, titanium oxide, titanium carbide, silicon, boron and boron nitride. Particularly, the film includes the graphite. Since the listed material can exhibit a smaller relative density and a smaller vapor pressure at high temperature, the listed material is preferable as the material of the film because the listed material is unlikely to be solid-solved with the material of the rotating anticathode such as Cu or Co and to vaporize by itself. If the film includes a material with electric conduction, the electric charge of the film due to the irradiation of the electron beam can be suppressed so that the destruction of the film can be prevented effectively and efficiently.

According to the present invention can be suppressed, in a rotating anticathode X-ray generating apparatus and an X-ray generating method, the consumption of the rotating anticathode by the irradiation of electron beams onto the rotating anticathode.

DETAILED DESCRIPTION OF THE INVENTION

Figure 1:
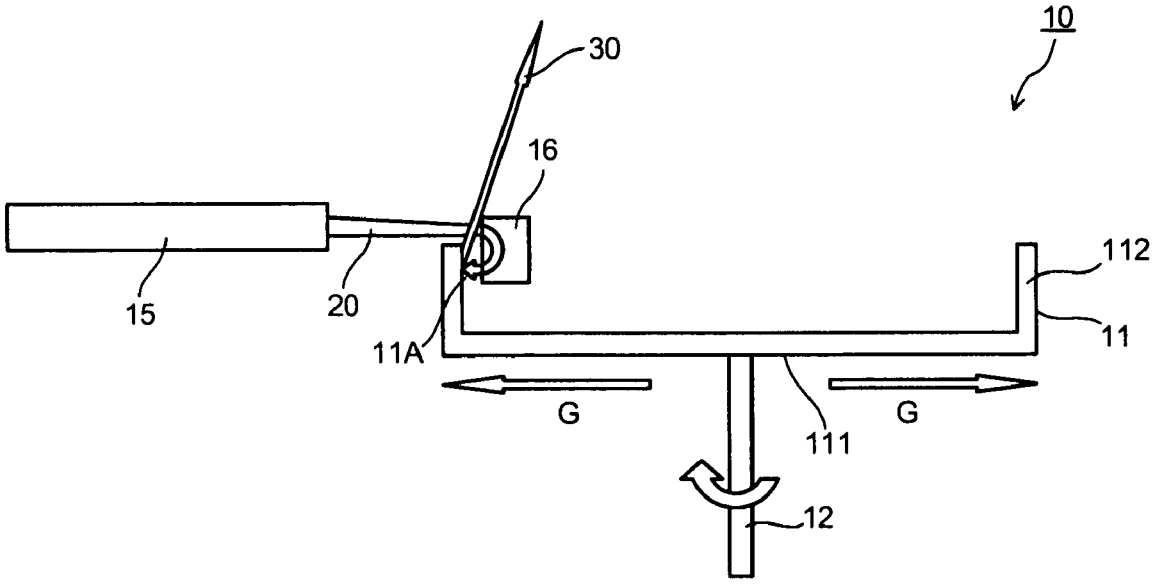
FIG. 1 is a structural view showing the essential part of a rotating anticathode X-ray generating apparatus according to the present invention.
Figure 2:
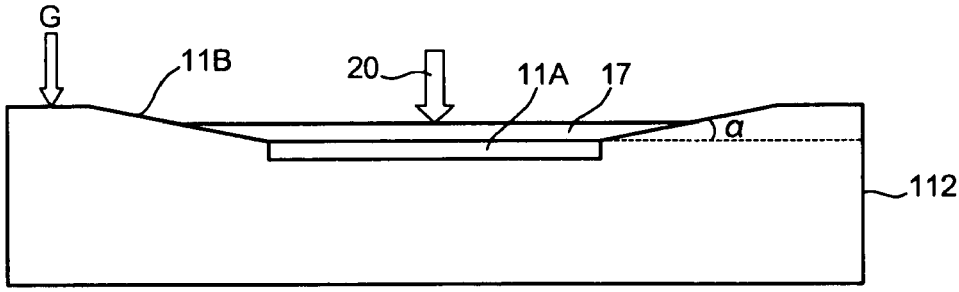
FIG. 2 is an enlarged view showing the area containing the electron beam irradiating portion in the rotating anticathode X-ray generating apparatus shown in FIG. 1.

Hereinafter, the present invention will be described in detail with reference to the drawings. FIG. 1 is a structural view showing the essential part of a rotating anticathode X-ray generating apparatus according to the present invention. FIG. 2 is an enlarged view showing the area containing the electron beam irradiating portion in the rotating anticathode X-ray generating apparatus shown in FIG. 1.

As shown in FIG. 1, the rotating anticathode X-ray generating apparatus 10 includes an rotating anticathode 11 and an electron gun 15 as an electron beam source. The rotating anticathode 11 includes a main body 111 mechanically connected with a rotating shaft 12 and a cylindrical portion 112 provided vertically for the main body 111. The cylindrical portion 112 constitutes the side wall of the rotating anticathode 11. The main body 111 is formed almost circularly so that the cylindrical portion 112 is provided vertically at the periphery of the main body 111. The rotating anticathode 11 is rotated around the rotating shaft 12 attached to the bottom surface thereof (the bottom surface of the main body 111), e.g., along the direction designated by the arrow.

An electron beam is emitted from the electron gun 15, and deflected by about 180 degrees and with a deflecting electron lens 16, and irradiated onto the inner wall of the cylindrical portion 112 of the rotating anticathode 11, thereby forming an electron beam irradiating portion 11A. The electron beam irradiating portion 11A is excited by the irradiation of the electron beam 20 to generate an intended X-ray 30.

Then, the structure of the electron beam irradiating portion 11A will be described with reference to FIG. 2. As described above, the electron beam irradiating portion 11A is formed on the inner wall of the cylindrical portion 112, but in this embodiment, an inverted trapezoidal trench 11B is formed at the inner wall of the cylindrical portion 112 so that the electron beam irradiating portion 11A is positioned at the trench 11B as shown in FIG. 2. The electron beam irradiating portion 11A is covered with a film 17. Herein, the film 17 is formed in the trench 11B so as to cover the electron beam irradiating portion 11A. in this case, the rear side of the cylindrical portion 112 may be cooled appropriately.

The rising angle $\alpha$ of the trench 11B is set to less than several degrees so that the X-ray 30 can not be absorbed by the edges of the trench 11B.

Then, the X-ray generating process using the rotating anticathode X-ray generating apparatus shown in FIGS. 1 and 2 will be described. As shown in FIGS. 1 and 2, the rotating anticathode 11 is rotated at a predetermined angular velocity around the rotating shaft 12 by a drive such as a motor (not shown). Then, a given centrifugal force G is generated outward at the rotating anticathode 11 around the rotating shaft 12. Then, the electron beam 20 is emitted from the electron gun 15, and deflected by about 180 degrees by the deflecting electron lens 16, and irradiated onto the cylindrical portion 112 of the anticathode 11, thereby forming the electron beam irradiating portion 11A.

In this case, since the electron beam irradiating portion 11A is formed at the inner wall of the cylindrical portion 112, the electron beam irradiating portion 11A can be easily formed at the rotating anticathode 11 so that the direction of the centrifugal force G can be parallel to the irradiating direction of the electron beam 20.

In this case, the electron beam irradiating portion 11A is excited by the irradiation of the electron beam 20 to generate the X-ray 30. As is apparent from FIGS. 1 and 2, the direction of the centrifugal force G is set equal to the irradiating direction of the electron beam 20. Therefore, even though the intensity of the electron beam 20 is increased to at least partially melt the electron beam irradiating portion 11A of the rotating anticathode 11, the melted portion of the electron beam irradiating portion 11A is held on the cylindrical portion 112 by the centrifugal force G. On the other hand, since the electron beam 20 with high intensity is irradiated onto the electron beam irradiating portion 11A, the brightness of the X-ray 30 to be generated from the electron beam irradiating portion 11A is increased.

In this case, the electron beam irradiating portion 11A and the area around the electron beam irradiating portion 11A are heated to a temperature beyond the melting point of the material making the rotating anticathode 11 by the melting of the electron beam irradiating portion 11A. Therefore, the material of the rotating anticathode 11 vaporizes conspicuously with the generation of the X-ray 30. In this embodiment, however, since the film 17 is formed in the trench 17 so as to cover the electron beam irradiating portion 11A, the evaporation of the material making the rotating anticathode 11 can be suppressed. As a result, if the X-ray 30 with high brightness is generated, the consumption of the rotating anticathode 11 can be suppressed effectively and efficiently.

In this embodiment, the electron beam irradiating portion 11A is positioned in the inverted trapezoidal trench 11B of the cylindrical portion 112 of the rotating anticathode 11 and the film 17 is formed in the trench 11B. Since the relative density of the material of the film 17 is set smaller than the relative density of the material of the rotating anticathode 11, the film 17 is fixed in the trench 11B by the centrifugal force G and the film 17 can not be contaminated with the material of the rotating anticathode 11 by the release and/or melting of the material of the rotating anticathode 11 through the irradiation of the electron beam 20.

It is desired that the film 17 is made of a material not soluble for the electron beam irradiating portion 11A. If the film 17 is solid-solved with the rotating anticathode 11, that is, the electron beam irradiating portion 11A, the film 17 can not maintain the inherent shape so as not to exhibit the above-described function/effect.

Concretely, the film 17 preferably includes at least one selected from the group consisting of graphite, diamond, alumina, calcium oxide, magnesium oxide, titanium oxide, titanium carbide, silicon, boron and boron nitride. Particularly, the film 17 includes the graphite. Since the listed material can exhibit a smaller relative density and a smaller vapor pressure at high temperature, the listed material is preferable as the material of the film 17 because the listed material is unlikely to be solid-solved with the material of the rotating anticathode (target) such as Cu or Co and to vaporize by itself. If the film 17 includes a material with electric conduction, the electric charge of the film 17 due to the irradiation of the electron beam can be suppressed so that the destruction of the film 17 can be prevented effectively and efficiently.

Figure 3:
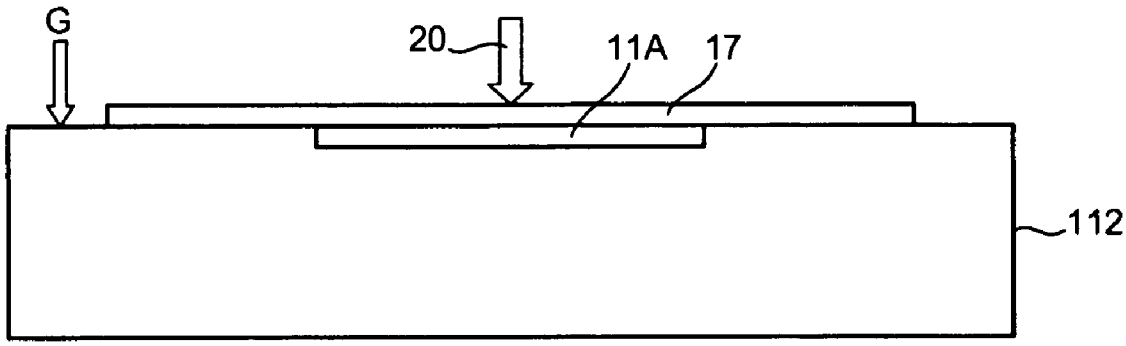
FIG. 3 is another enlarged view showing the area containing the electron beam irradiating portion in the rotating anticathode X-ray generating apparatus shown in FIG. 1.

FIG. 3 is another enlarged view showing the area containing the electron beam irradiating portion in the rotating anticathode X-ray generating apparatus shown in FIG. 1.

In the above-described embodiment, the electron beam irradiating portion 11A is positioned in the inverted trapezoidal trench 11B of the cylindrical portion 112 of the rotating anticathode 11 and the film 17 is formed in the trench 11B. In this embodiment, the cylindrical portion 112 of the rotating anticathode 11 is formed flat so that no trench is formed. In this case, the electron beam irradiating portion 11A is positioned on the flat surface of the cylindrical portion 112 and the film 17 is formed on the same flat surface so as to cover the electron beam irradiating portion 11A. In this case, the evaporation of the material making the rotating anticathode 11 can be suppressed even though the electron beam irradiating portion 11A is heated to a temperature beyond the melting point of the material making the rotating anticathode 11. As a result, if the X-ray 30 with high brightness is generated, the consumption of the rotating anticathode 11 can be suppressed effectively and efficiently.

In this embodiment, the film 17 is fixed to the flat surface of the cylindrical portion 11A physically and chemically in addition to the centrifugal force G.

Other requirements of the film 17 can be determined in the same manner as in the above-described embodiment.

Although the present invention was described in detail with reference to the above examples, this invention is not limited to the above disclosure and every kind of variation and modification may be made without departing from the scope of the present invention.

For example, in the above-described embodiment, the cylindrical portion 112 is provided vertically at the periphery of the main body 111, but may be inclined toward the rotating shaft 12 by several degrees from the normal line of the main body 111. In this case, even though the electron beam irradiating portion 11A is melted, the melted portion of the electron beam irradiating portion 11A can be prevented more effectively. Then, the cylindrical portion 112 may be inclined outward from the rotating shaft 12. In this case, the generated X-ray 30 can be taken out easily.

What is claimed is:

1. A rotating anticathode X-ray generating apparatus which is configured such that an X-ray is generated by an irradiation of an electron beam emitted from a cathode, comprising:

a rotating anticathode with an electron beam irradiating portion to generate said X-ray through said irradiation of said electron beam so that a direction of said electron beam is set equal to a direction of a centrifugal force caused by a rotation of said rotating anticathode; and a film for covering at least said electron beam irradiating portion so as to prevent an evaporation of a material making said rotating anticathode.

2. The generating apparatus as set forth in claim 1, wherein said rotating anticathode includes a cylindrical portion with a center axis corresponding to a rotation center of said rotating anticathode, and said electron beam irradiating portion is formed on an inner wall of said cylindrical portion.

3. The generating apparatus as set forth in claim 1, wherein said electron beam irradiating portion is positioned in an inverted trapezoidal trench formed at said rotating anticathode and said film is formed in said trench.

4. The generating apparatus as set forth in claim 1, wherein said electron beam irradiating portion is configured so as to be at least partially melted by said electron beam.

5. The generating apparatus as set forth in claim 1, wherein said film is made of a material not soluble for said rotating anticathode.

6. The generating apparatus as set forth in claim 5, wherein said film includes at least one selected from the group consisting of graphite, diamond, alumina, calcium oxide, magnesium oxide, titanium oxide, titanium carbide, silicon, boron and boron nitride.

7. The generating apparatus as set forth in claim 6, wherein said film includes graphite.

8. A method for generating an X-ray by irradiating an electron beam from a cathode, comprising the steps of:

forming an electron beam irradiating portion on a rotating anticathode so that a direction of said electron beam is set equal to a direction of a centrifugal force caused by a rotation of said rotating anticathode, thereby generating said X-ray; and covering at least said electron beam irradiating portion with a film so as to prevent an evaporation of a material making said rotating anticathode.

9. The generating method as set forth in claim 8, wherein said rotating anticathode includes a cylindrical portion with a center axis corresponding to a rotation center of said rotating anticathode, and said electron beam irradiating portion is formed on an inner wall of said cylindrical portion.

10. The generating method as set forth in claim 8, wherein said electron beam irradiating portion is positioned in an inverted trapezoidal trench formed at said rotating anticathode and said film is formed in said trench.

11. The generating method as set forth in claim 8, wherein said electron beam irradiating portion is configured so as to be at least partially melted by said electron beam.

12. The generating method as set forth in claim 8, wherein said film is made of a material not soluble for said rotating anticathode.

13. The generating method as set forth in claim 12, wherein said film includes at least one selected from the group consisting of graphite, diamond, alumina, calcium oxide, magnesium oxide, titanium oxide, titanium carbide, silicon, boron and boron nitride.

14. The generating method as set forth in claim 13, wherein said film includes graphite.

* * * * *